US005820495A

United States Patent [19]

Howland

[11] Patent Number: 5,820,495

[45] Date of Patent: Oct. 13, 1998

[54] CURVE BALL TRAINING

[76] Inventor: Kevin Michael Howland, 419-C Talmage Road, Ukiah, Calif. 95482

[21] Appl. No.: 625,468

[22] Filed: Mar. 29, 1996

[51] Int. Cl.[6] ..... A63B 69/00

[52] U.S. Cl. ..... 473/451

[58] Field of Search ..... 273/26 R, 26 D, 273/58 R, 58 C, 58 E, 58 G; 473/451, 468

[56] References Cited

U.S. PATENT DOCUMENTS

| | | | |
|---|---|---|---|
| 2,925,273 | 2/1960 | Pratt | 273/26 R |
| 3,110,494 | 11/1963 | Morgan . | |
| 3,152,803 | 10/1964 | Sain | 273/26 R |
| 3,874,663 | 4/1975 | Kahle . | |
| 3,918,720 | 11/1975 | Gordos . | |
| 4,153,248 | 5/1979 | Holmes . | |
| 4,411,431 | 10/1983 | Judice . | |
| 4,801,141 | 1/1989 | Rumsey | 273/58 E |
| 4,846,471 | 7/1989 | Haysom . | |
| 4,930,773 | 6/1990 | Outlaw | 273/26 R |
| 4,991,838 | 2/1991 | Groves | 273/26 R |
| 5,407,193 | 4/1995 | McGinley | 273/26 R |

OTHER PUBLICATIONS

Adair, R.K. *The Physics of Baseball*, Harper and Row, 1990.

*Primary Examiner*—William H. Grieb
*Attorney, Agent, or Firm*—Fish & Richardson P.C.

[57] ABSTRACT

A training ball for use by a pitcher in practicing throwing a curve ball and a method for using the training ball as described. The training ball has a first ball having approximately the size, weight, and surface of a regulation baseball, for being held and thrown by the pitcher, and a counterweight connected to the first ball at a fixed distance and position, to provide a mass balancing the mass of the first ball at a balance point approximately at the surface of the sphere defined by the surface of the first ball. The first ball may be a modified regulation baseball. The counterweight may be a second ball approximately identical in size and weight to the first ball. The method for using a training ball includes gripping and throwing the first ball as a curve ball, whereby the training ball will fly with a 12-6 spin toward the pitcher's target if the training ball is properly thrown.

13 Claims, 6 Drawing Sheets

CURVE BALL TRAINING

BACKGROUND OF THE INVENTION

1. Field of the Invention

The invention relates to devices and methods for training in the technique for throwing a curve ball.

2. Background

A regulation baseball is a hard sphere formed by yarn wound around a core and covered with two stripes of horsehide or cowhide stitched together. It weighs between 5 and 5-¼ ounces avoirdupois and measures between 9 and 9-¼ inches in circumference.

A baseball may be pitched to curve in flight by imparting a spin on the ball as it is thrown. Variations in technique involving the motions of the arm, wrists, and hand will result in different trajectories by the ball in flight. The physics of the flight of a pitched ball, including that of a curve ball, are discussed in Robert K. Adair, The Physics of Baseball, Harper & Row, 1990, which is incorporated here by this reference.

Various devices and techniques have been developed over the years for training pitchers to throw a curve ball. Recent examples include those described in U.S. Pat. No. 5,407,193 to McGinley for Baseball Pitching Training Device; U.S. Pat. No. 4,991,838 to Groves for Marked Baseball Cover as Training Aid and Method for Use; and U.S. Pat. No. 4,930,773 to Outlaw for Curve Ball Training Device.

SUMMARY OF THE INVENTION

In general, in one aspect, the invention provides a training ball for use by a pitcher in practicing throwing a curve ball. The training ball preferably has a first ball having approximately the size, weight, and surface of a regulation baseball, for being held and thrown by the pitcher, and a counterweight connected to the first ball at a fixed distance and position, to provide a mass balancing the mass of the first ball at a balance point approximately at the surface of the sphere defined by the surface of the first ball. In another aspect, the first ball is a modified regulation baseball. However, balls smaller or larger than a baseball may also be used. In another aspect, the training ball has means for preventing the counterweight from rotating with respect to the first ball around the axis between the first ball and the counterweight. In another aspect, the counterweight of the training ball is preferably a second ball approximately identical in size and weight to the first ball. However, unequally sized balls may be used. In another aspect, the balance point between the first ball and the counterweight is within 2 inches of the sphere defined by the surface of the first ball. Preferably the balance point will be within ¼ inch of the sphere defined by the surface of the first ball.

In general, in another aspect, the invention provides a method for use by a pitcher in practicing throwing a curveball. The method includes taking a training ball, having a first ball for throwing connected to a counterweight balancing the weight of the first ball at a balance point approximately at the surface of the first ball, and throwing the first ball as a curve ball, whereby the training ball will fly with a 12-6 spin toward the pitcher's target if the training ball is properly thrown. A 12-6 spin means that the plane of rotation of the ball and counterweight about each other is vertical to the ground, i.e., the end view of the plane of rotation is 12 o'clock and 6 o'clock as seen from the thrower. In another aspect, the method includes use of a first ball that is a modified regulation baseball. In another aspect, the method includes use of a training ball with means for preventing the counterweight from rotating with respect to the first ball around the axis between the first ball and the counterweight. In another aspect, the method includes use of a training ball where the counterweight is a second ball approximately identical in size and weight to the first ball. In another aspect, the method includes use of a training ball where the balance point is within 2 inches of the sphere defined by the surface of the first ball.

Preferably the balance point will be within ¼ inch of the sphere defined by the surface of the first ball.

The invention has a number of advantages. For example, the invention teaches pitching motion, hand and finger grip, and when to release the ball. It may be used by either right or left handed pitchers. It may be used both for initial learning and as a remedial tool. It provides immediate visual and tactical information to the pitcher.

Other advantages and features will become apparent from he following description and from the claims.

BRIEF DESCRIPTION OF THE DRAWINGS

The accompanying drawings, which are incorporated in, and constitute a part of, the specification, schematically illustrate specific embodiments of the invention and, together with the general description given above and the detailed description of the embodiments given below, serve to explain the principles of the invention.

DETAILED DESCRIPTION

Figure 1:
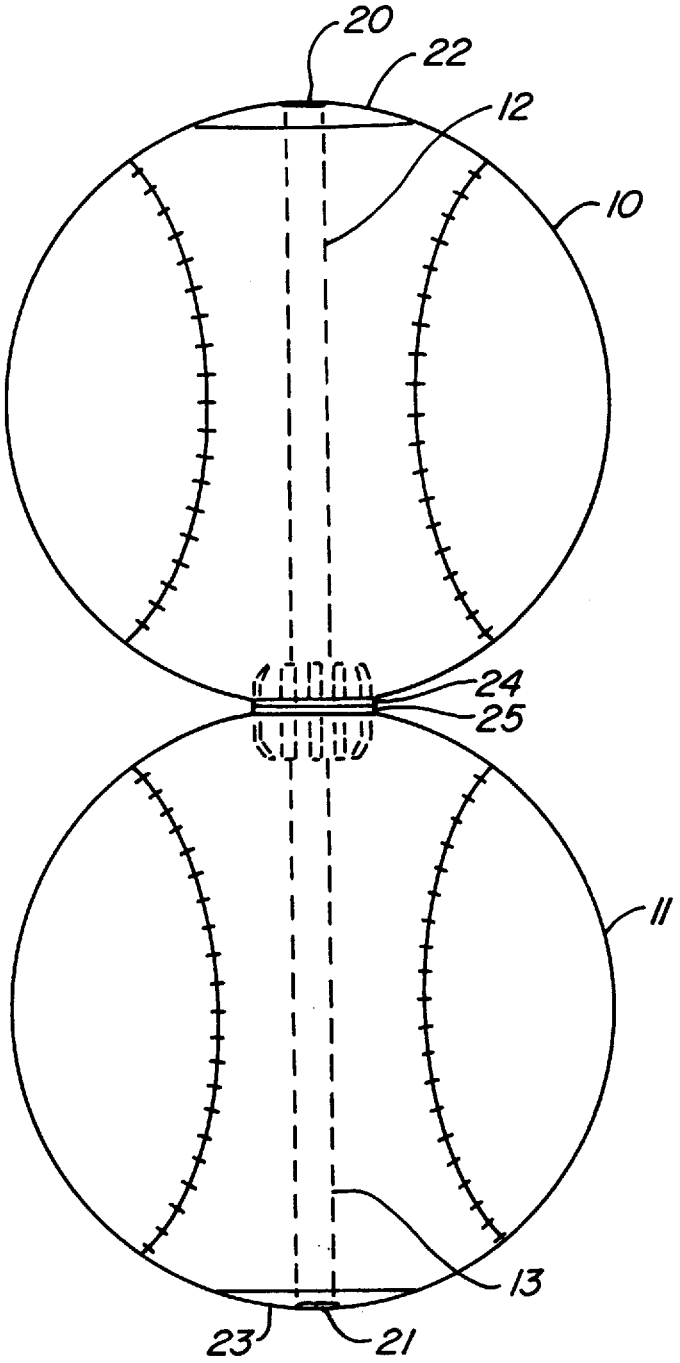
FIG. 1 shows a training ball.

Turning to FIG. 1, a training ball is made by joining two balls 10 and 11 together. As shown, the balls are the same size, but they may also be unequal in size. A hole 12 and 13 passing through the center of each baseball is drilled through each baseball.

Figure 2:
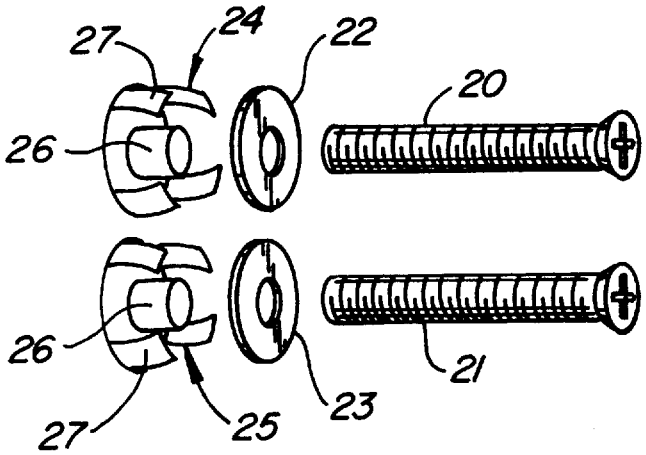
FIG. 2 illustrates a set of connecting hardware to make a training ball from two handballs.

Turning to FIG. 2, the two baseballs 10 and 11 may be jointed by a pair of steel bolts 20 and 21. The bolts pass through steel end caps 22 and 23 before entering the baseballs. The outside surface of each end cap is rounded so as generally to match the round shape of the baseball, while the inside surface mates to an indentation in the base Ball made to match the end cap. The bolts 20 and 21 screw into a pair of steel setcaps 24 and 25, each of which has; threaded portion 26 to receive a bolt and a set of teeth 27 to engage a baseball. The setcaps 24 and 25 are joined back to back, for example by welding, so that their threaded portions 26 are aligned and facing away from each other. The baseballs are joined and held close together by bolts 20 and 21 being screwed into setcaps 24 and 25, as shows in FIG. 1. The baseballs 20 and 21 are so positioned that, were it not for the hardware, they would be close to touching, preferably less than ¼ inch apart, and generally less than 4 inches apart.

Figure 3:
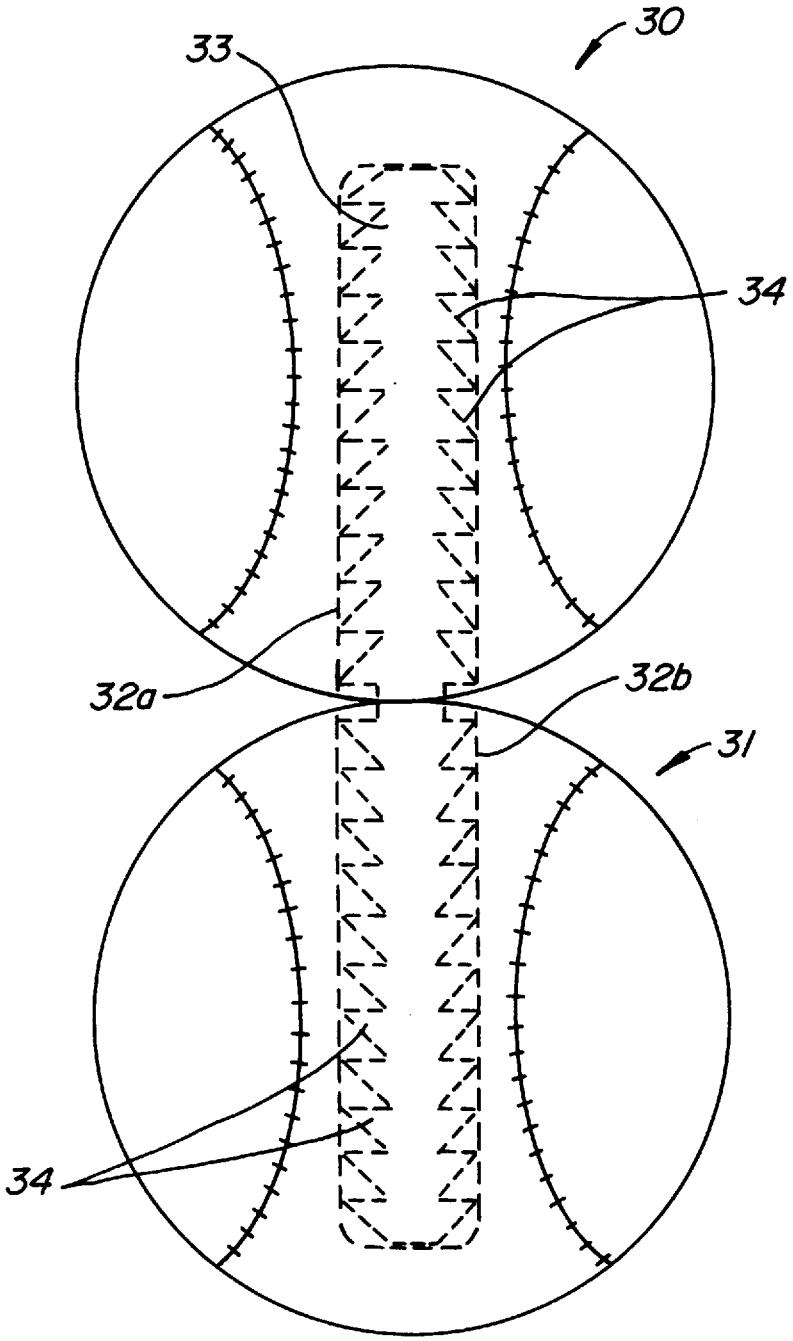
FIG. 3 illustrates another embodiment in which two handballs are connected by a flanged connector.

Referring to FIG. 3, there are shown two baseballs, 30 and 31. Each baseball has a uniform diameter hole, 32*a* and 32*b*, respectively directed toward and through the center, but not completely through the baseball. The baseballs are joined by a multi-flanged connector, 33, with flanges 34 directed so that, on one half of the connector 33 it can be inserted but not withdrawn from the hole 32*a* in baseball 30, while on the other half of the connector 33 the flanges are facing in the opposite direction so that the connector 33 can be inserted, but not withdrawn from the hole 32*b* in the other baseball 31. The connector 33 is preferably made of a strong material such as hard plastic, aluminum or hard resin. The maximum diameter of each flange 34 is slightly larger than the maximum diameter of holes 32*a* and 32*b*, such that flexing and/or slippage along the slanted face of each flange can occur during insertion, but the opposite perpendicular surfaces of each flanges, in the aggregate, prevent the connector from being readily withdrawn from the hole.

Figure 4:
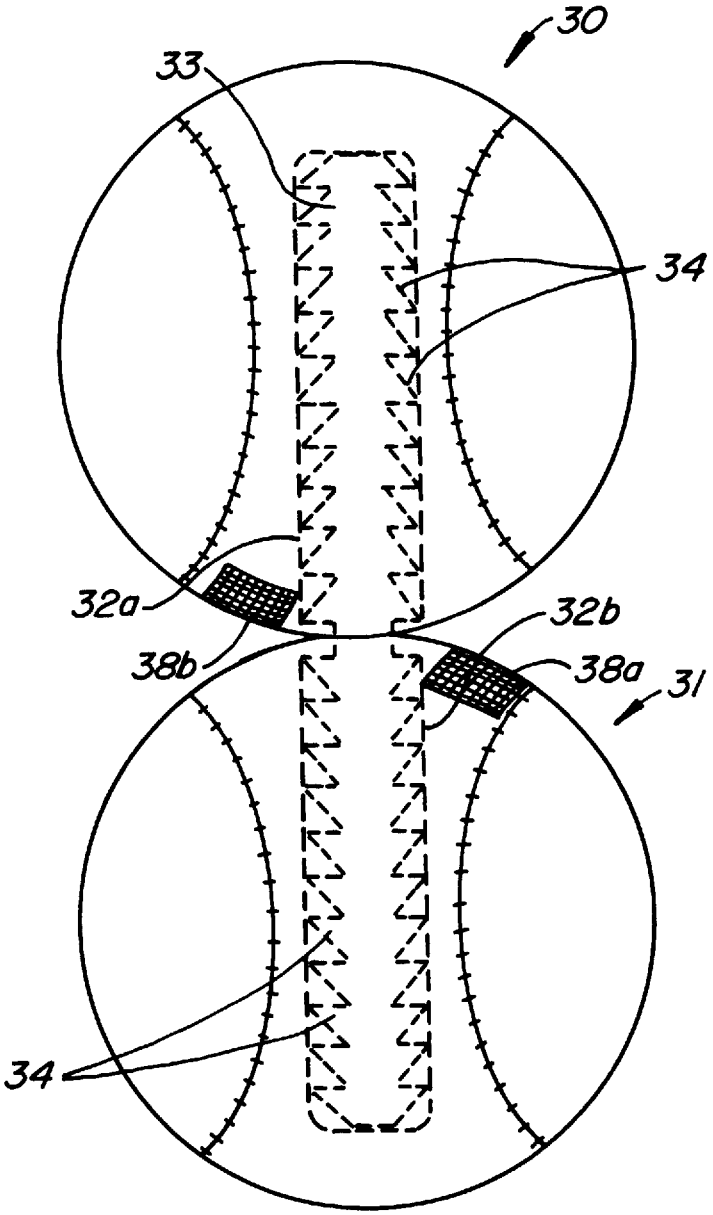
FIG. 4 illustrates the embodiment of FIG. 3 having sound-emitting devices.

Referring to FIG. 4, the baseballs 30 and 31 are shown with sound-emitting devices, 38*b* and 38*a*, respectively.

Figure 5:
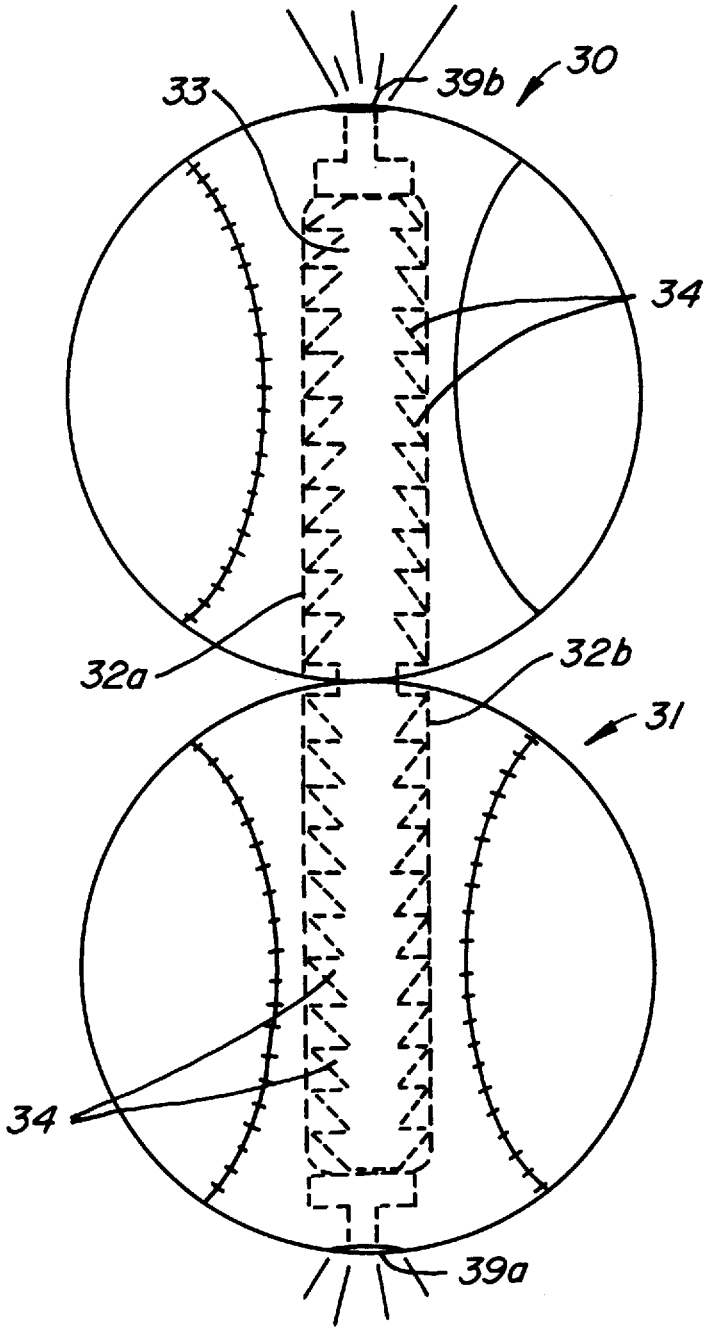
FIG. 5 illustrates the embodiment of FIG. 3 having light-emitting devices.

Referring to FIG. 5, the baseballs 30 and 31 are shown with light-emitting devices, 39*b* and 39*a*, respectively.

Figure 6A:
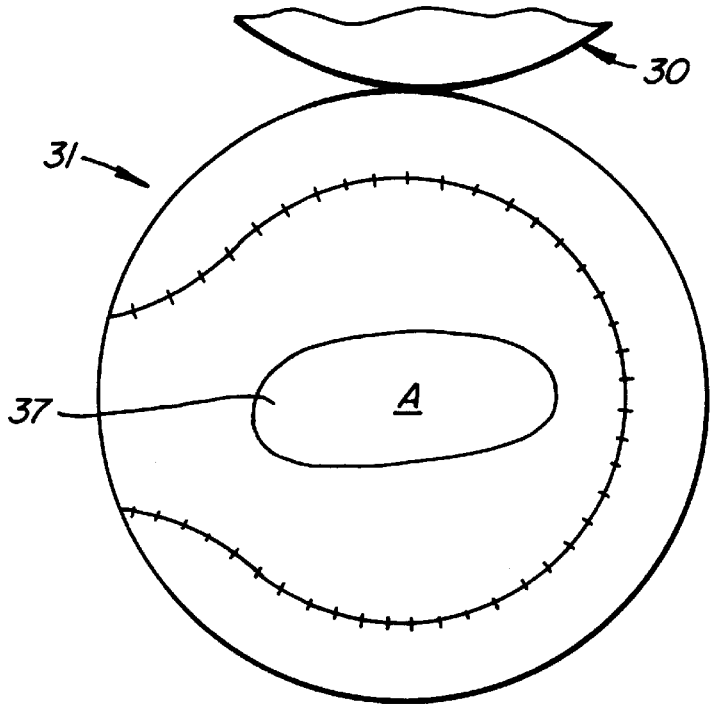
FIGS. 6A and 6B show the embodiment of FIG. 3 with markings for proper finger location for throwing.
Figure 6B:
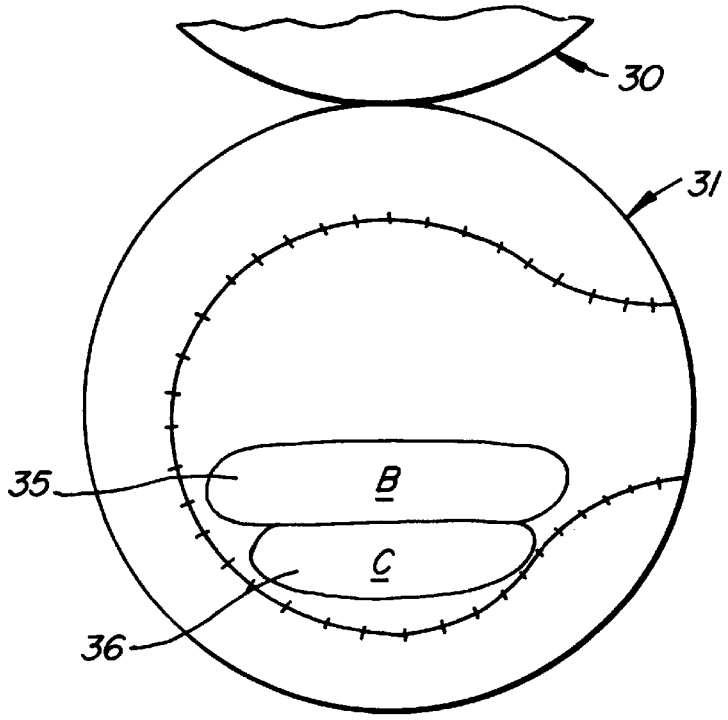

Referring to FIG. 6A and 6B, there are shown proper finger markings for gripping baseball 31. In FIG. 6A, the location of the thumb, A, is indicated. The reverse side of baseball 31 is shown in FIG. 6B, showing the location of the index finger, B, and the middle finger, C, for proper gripping of the baseball.

When one of the balls 20 or 21 is properly gripped and thrown as a curve ball, the training ball will spin with the balls 20 and 21 passing one over the other. (This is sometimes called a 12-6 spin.) The training ball will also fly to the pitcher's target. If not properly thrown, the training ball will fly out of the pitcher's hand and fly in an unintended direction, such as over the pitcher's target, or it will fly with an unintended spin.

The proper grip will be known to a thrower of sufficient experience or a coach. Typically, the grip will require the thrower to cause a "4-seam rotation", which imputes a conventional curve to the flight of ball. To assist in attaining the proper grip, at least one of the balls may be provided with permanent marks (not shown) to indicate placement of fingers in the proper location relative to the seams on the ball.

The present invention has been described in terms of specific embodiments. The invention, however, is not limited to the specific embodiment. Rather, the scope of the invention is defined by the following claims, and other embodiments are within the scope of the claims. For example, the baseballs may be joined by hardware made of materials other than steel or of plastics or other materials. One or both end caps in FIG. 1 may be integral with a bolt, and a single bolt may be provided to extend substantially through both balls. The shank of the bolt or bolts may be of a generally round, square, or other cross-section. The hardware may be further secured by lockwashers or locking nuts. The hardware may be secured in part or entirely by welding, including sonic welding, or adhesives. In place of regulation baseballs, spheres of regulation size and weight may be used. In place of the second baseball (the one that is not held for throwing), weight may be attached radially to the first baseball to provide equivalent inertial moments and center of mass.

It will also be appreciated that various modifications may be made without departing from the spirit and scope of the invention. For example, the two balls may be provided in different colors to better observe their flight. Sound or light emitters may be used to which are calibrated to emit a sound or flash when the balls are on a true flight rotating perpendicularly to the ground, have a velocity in a predetermined range, or other characteristics of motion that can be electronically sensed. These and other such modifications are deemed to be within the scope of the invention.

What is claimed is:

1. A training device for use in practicing throwing a curve ball, comprising:

a first ball being held and thrown by the user; and a counterweight connected to the first ball at a fixed position, the counterweight providing a balance point by its mass which balances the mass of the first ball.

2. The training device of claim 1, where the first ball is a regulation baseball modified for connection to the counterweight.

3. The training device of claim 1, where the counterweight is a second ball approximately identical in size and weight to the first ball.

4. The training device of claim 1, where the balance point is within 2 inches of the sphere defined by the surface of the first ball.

5. The training device of claim 1, where the balance point is within ¼ inch of the sphere defined by the surface of the first ball.

6. The training device of claim 3, wherein said first and second balls each accommodate a hole and are connected by a flanged connector inserted into said holes.

7. The training device of claim 1 further comprising a sound-emitting indicator to signal proper flight or velocity of the device.

8. The training device of claim 1 further comprising a light-emitting indicator to signal proper flight or velocity of the device.

9. The device according to claim 1 having indicators on said ball to indicate proper location of the user's fingers for gripping said ball.

10. A method for adapting the throwing motion to throwing a curve ball, comprising:

gripping a first ball for throwing, said first ball connected to a counterweight which balances the weight of the first ball by its mass at a balance point; and throwing the first ball in a manner, whereby the first ball and said counterweight rotate about each other with a 12-6 spin toward the thrower's target if properly thrown.

11. The method of claim 10, where the first ball comprises a regulation baseball.

12. The method of claim 10, wherein the counterweight is a second ball approximately identical in size and weight to the first ball.

13. The method of claim 10, wherein the balance point is within 2 inches of the sphere defined by the surface of the first ball.

* * * * *